US008316666B2

(12) United States Patent
Patterson

(10) Patent No.: US 8,316,666 B2
(45) Date of Patent: Nov. 27, 2012

(54) JEWELRY ARTICLE WITH CHANGEABLE SETTING

(76) Inventor: Mary L Patterson, Buffalo Grove, IL (US)

( * ) Notice: Subject to any disclaimer, the term of this patent is extended or adjusted under 35 U.S.C. 154(b) by 195 days.

(21) Appl. No.: 12/835,598

(22) Filed: Jul. 13, 2010

(65) Prior Publication Data

US 2012/0011888 A1 Jan. 19, 2012

(51) Int. Cl.
*A44C 9/00* (2006.01)

(52) U.S. Cl. ..... 63/15.4; 63/15.1

(58) Field of Classification Search ..... 63/15, 15.2, 63/15.3, 15.4, 15.1, 29.1, 30, 40, 27; D11/91
See application file for complete search history.

(56) References Cited

U.S. PATENT DOCUMENTS

| | | | | | |
|---|---|---|---|---|---|
| 899,296 | A | | 9/1908 | Elliot | |
| 1,152,340 | A | | 8/1915 | Osboum | |
| 1,186,271 | A | * | 6/1916 | Block | 63/15.2 |
| 1,326,977 | A | | 1/1920 | Schwartzman | |
| 1,800,227 | A | * | 4/1931 | Novack | 63/15 |
| 2,117,176 | A | * | 5/1938 | Keehnel et al. | 63/15.4 |
| 2,151,607 | A | * | 3/1939 | Lovell | 63/15.3 |
| 2,177,314 | A | * | 10/1939 | Von Dachenhausen | 63/15.4 |
| 2,220,408 | A | * | 11/1940 | Kalina | 63/15 |
| 2,308,915 | A | * | 1/1943 | Haimes et al. | 63/15.4 |
| 3,115,758 | A | | 12/1963 | Eberle et al. | |
| 3,653,227 | A | | 4/1972 | Ricci | |
| 4,118,948 | A | * | 10/1978 | Gralnik | 63/15 |
| 4,307,502 | A | * | 12/1981 | Scola | 29/896.412 |
| 4,488,415 | A | * | 12/1984 | Jenkins | 63/29.1 |
| 4,742,696 | A | | 5/1988 | Jenkins | |
| 4,794,766 | A | | 1/1989 | Schunk et al. | |
| D309,276 | S | | 7/1990 | Mejias | |
| 5,077,989 | A | | 1/1992 | Dillabaugh | |
| 5,228,317 | A | * | 7/1993 | Hendricks | 63/15.7 |
| 5,253,490 | A | * | 10/1993 | Doganay | 63/15.4 |
| 5,419,158 | A | * | 5/1995 | Sandberg et al. | 63/15.4 |
| 5,596,887 | A | * | 1/1997 | Bergagnini | 63/15.1 |
| D377,769 | S | * | 2/1997 | Roemer | D11/26 |

(Continued)

OTHER PUBLICATIONS

"Over the top ring embracer" presented on the applicant's web site: www.marilujewelrydesign.com.

*Primary Examiner* — Thomas B Will
*Assistant Examiner* — Abigail E Morrell
(74) *Attorney, Agent, or Firm* — Lonnie R Drayer

(57) ABSTRACT

A frame member has two spaced apart parallel rings that are fixed to one another only at a first location. At a second location diametrically opposed to the first location each of the spaced apart parallel rings has a pedestal with a notch therein at an edge of the pedestal adjacent a space separating the parallel rings. The pedestals and notches are circumferentially aligned to cooperate with one another to provide a seat for seating an ornamental article therein. The securing member secures the ornamental article to the frame member. The securing member is a ring inserted in the space between the parallel rings of the frame member in a movable manner and is provided with a means for securing the ornamental article seated in the pedestals and notches of the frame member when the means for securing is aligned with the pedestals and notches of the frame member. The securing member may be moved with respect to the frame member to allow the ornamental article to be removed and replaced by another ornamental article, and then moved back to its original position with respect to the frame member to secure replacement ornamental article in place.

8 Claims, 11 Drawing Sheets

U.S. PATENT DOCUMENTS

| | | | | |
|---|---|---|---|---|
| 5,606,874 | A | 3/1997 | Archetti et al. | |
| 5,727,399 | A * | 3/1998 | Bergagnini | 63/15.4 |
| 5,996,374 | A | 12/1999 | Bardisbanyan | |
| 6,131,408 | A | 10/2000 | Gill | |
| 6,318,122 | B1 | 11/2001 | Burgard | |
| 6,427,487 | B1 | 8/2002 | Morgan | |
| 6,490,886 | B1 | 12/2002 | Steinhauer et al. | |
| 6,601,408 | B2 | 8/2003 | Burgard | |
| 6,701,747 | B2 | 3/2004 | Hartgrove | |
| 6,711,915 | B2 | 3/2004 | Quach | |
| 6,715,314 | B2 | 4/2004 | Rose | |
| 6,715,315 | B1 | 4/2004 | Hartgrove | |
| 6,729,159 | B2 | 5/2004 | Rose | |
| D525,556 | S * | 7/2006 | Sandberg | D11/34 |
| 7,143,607 | B2 | 12/2006 | Hartgrove | |
| 7,201,021 | B2 | 4/2007 | Hartgrove | |
| 7,222,503 | B2 | 5/2007 | Golove | |
| 7,322,212 | B2 | 1/2008 | Golove et al. | |
| D563,821 | S | 3/2008 | McKeever et al. | |
| D576,909 | S | 9/2008 | McKeever et al. | |
| 2005/0126223 | A1 * | 6/2005 | Maschio | 63/15 |

* cited by examiner

JEWELRY ARTICLE WITH CHANGEABLE SETTING

FIELD OF THE INVENTION

The present invention relates generally to an article of jewelry, and more specifically to a ring wherein an ornamental article displayed by the ring may be easily replaced by another ornamental article.

BACKGROUND OF THE INVENTION

The desirability of articles of jewelry, such as rings, pendants, earrings, bracelets, or broaches with interchangeable settings has long been evident in the art. Being interchangeable the setting can be matched to other articles of jewelry, clothing or accessories.

DISCUSSION OF THE PRIOR ART

Over one hundred years ago a ring provided using a set screw to facilitate the use of interchangeable stones in a setting was disclosed by W. R. Elliot in U.S. Pat. No. 899,296. Since then many articles of jewelry having interchangeable ornamental articles have been disclosed with varying degrees of commercial success, as evidenced for example by U.S. Pat. Nos. 1,186,271; 1,152,340; 1,326,977; 3,115,758; 3,653,227; 4,742,696; 4,794,766; 5,077,989; 5,606,874; 5,996,374; 6,131,408; 6,427,487; 6,490,886; 6,601,408; 6,701,747; 6,711,915; 6,715,314; 6,729,159; 7,143,607; 7,222,503, 7,322,212; D 563,821; and D 576,909.

While most articles of jewelry providing for interchangeable ornamental articles have a single ring shaped member, there are a few publications that disclose jewelry articles having more than one cooperating ring members.

U.S. Pat. No. 6,318,122 B1 discloses an interchangeable a rotatable jewelry display for beads or ornaments. The jewelry apparatus has a sole shaft for interchangeably displaying and rotating at least one ornament and a retainer comprising a first ring section and a second ring section. The first ring section has a sole shaft positionally disposed on the first ring section for interchangeably receiving and holding the ornament and allowing the ornament to rotate around the shaft. The second ring section has at least one arm for receiving the shaft of the first ring section and a catch slideably and rotatably inserted onto the shaft of the first ring section. The first ring section may be rotated away from the second ring section to facilitate the interchanging of various ornaments.

U.S. Pat. No. 6,715,315 B1 and U.S. Pat. No. 7,201,021 B2, which is a divisional thereof, disclose an article of jewelry having two adjoining ring members, referred to therein as "body portions" wherein the body portions are magnetically coupled to one another when the body portions are aligned with one another. At least one of the body portions is rotatable to tangentially break the magnetic coupling between the body portions to tangentially break the magnetic coupling between the body portions to interchange a setting. In another aspect of that invention magnetic elements are used to magnetically suspend a movable setting on a jewelry article.

U.S. Pat. No. 5,228,317 discloses a ring having two "ring shanks" that pivot around a pin parallel to the finger holes through the two "ring shanks". One of the "ring shanks" has a gem set receiving hole which receives a center gemstone prong setting when the two shanks are in an open position. When a center gemstone prong setting containing a center gemstone and a prong setting base is introduced into the gem setting hole and the two "ring shanks" are moved to their closed position, the escape path for the center gemstone prong setting is blocked and the center gemstone prong setting is locked in place. Locating a pivot pin closely adjacent to the setting provides a mechanical advantage to carry loads of large bezels and/or gemstone clusters around a replaceable or interchangeable centered gemstone.

FIGS. 1 and 2 of the present document show a ring 300 designed by the applicant of the present application and marketed as the "over the top ring embracer" presented on the applicant's web site: www.marilujewelrydesign.com. A frame member 312 has two spaced apart parallel rings 313, 314 that are fixed to one another at only one location 315. A circular portion 324 of a ring insert 323 is placed into a space 316 between the spaced apart parallel rings of the frame member. The separate ring insert has an ornamental article 321, shown in the figures as a genuine or artificial gemstone, permanently mounted thereto. A wire or pin 335 extends between two protrusions 332, 334 of the ring insert 323 and is circumferentially aligned with and radially outward of the permanently mounted ornamental article 321, spaced apart from the ornamental article and not contributing to the retention of the permanently mounted ornamental article. If it is desired to change the appearance of the "over the top ring embracer" by having a different ornamental article it is necessary to obtain a different ring insert provided with a permanently mounted ornamental article of a differing appearance, since the ornamental articles alone are not interchangeable in the setting of the ring.

SUMMARY OF THE INVENTION

There is provided in accordance with the present invention an article of jewelry comprising a frame member, a securing member. The frame member has two spaced apart parallel rings that are fixed to one another only at a first location. At a second location diametrically opposed to the first location each of the spaced apart parallel rings has a pedestal with a notch therein at an edge of the pedestal adjacent a space separating the parallel rings. The pedestals and notches are circumferentially aligned to cooperate with one another to provide a seat for seating an ornamental article therein. The securing member secures the ornamental article to the frame member. The securing member is a ring inserted in the space between the parallel rings of the frame member in a movable manner and is provided with a means for securing the ornamental article seated in the pedestals and notches of the frame member when the means for securing is aligned with the pedestals and notches of the frame member. The securing member may be moved with respect to the frame member to allow the ornamental article to be removed and replaced by another ornamental article, and then moved back to its original position with respect to the frame member to secure replacement ornamental article in place.

DETAILED DESCRIPTION OF THE INVENTION

Figure 1:
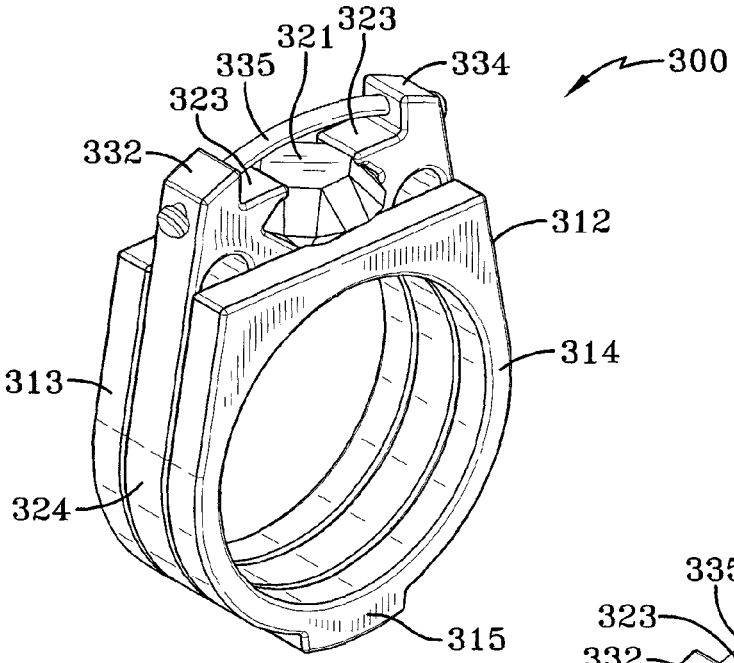
FIG-1 PRIOR ART
FIG. 1 is a first perspective view of a prior art ring.
Figure 2:
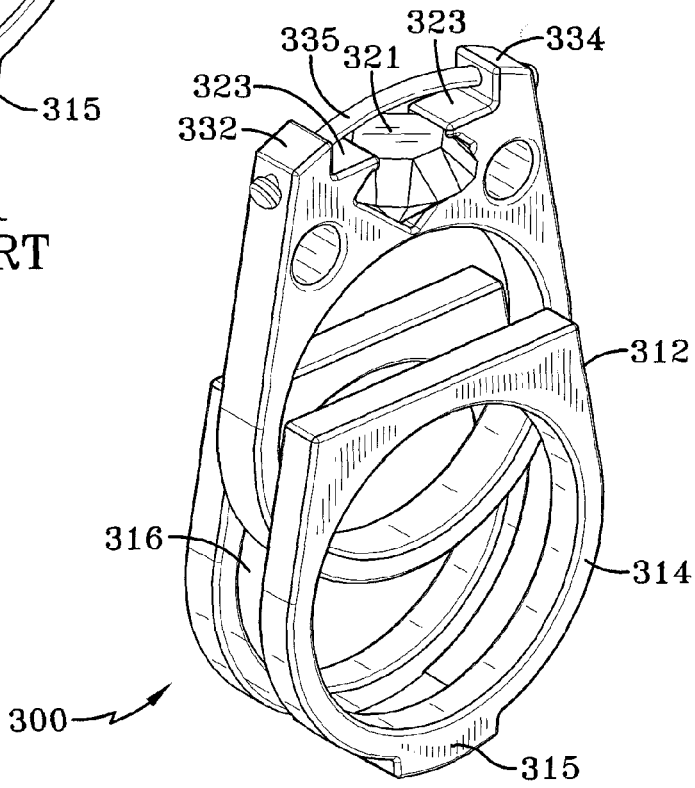
FIG-2 PRIOR ART
FIG. 2 is a second perspective view of the prior art ring with one component of the ring displaced with respect to the other component of the ring.
Figure 3:
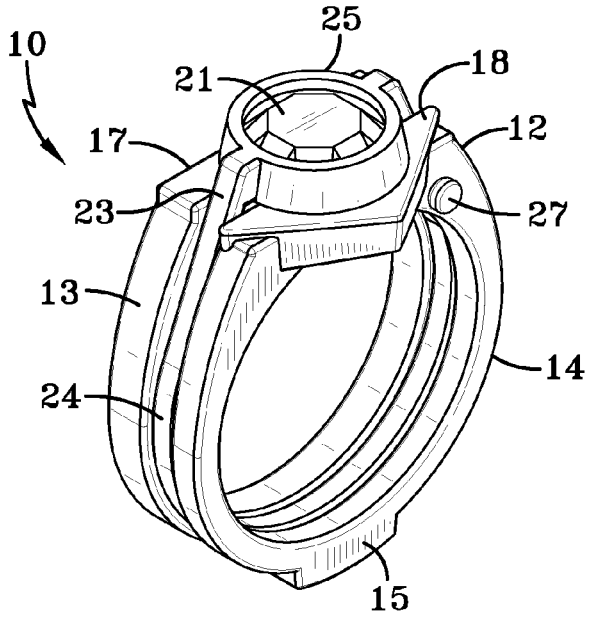
FIG. 3 is a first perspective view of an article of jewelry according to a first embodiment of the invention.
Figure 4:
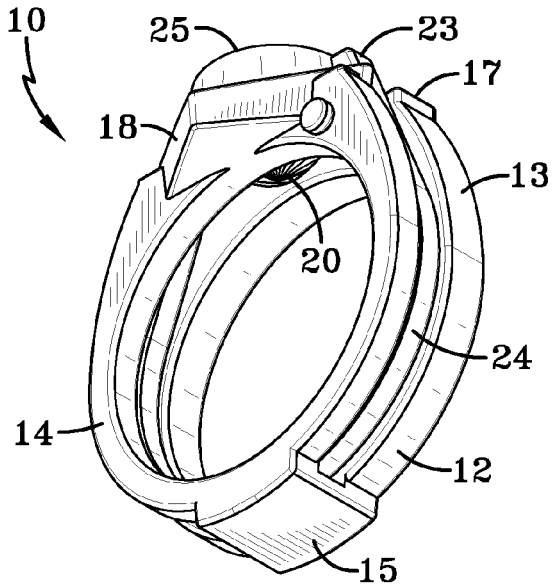
FIG. 4 is a second perspective view of the article of jewelry shown in FIG. 3.
Figure 5A:
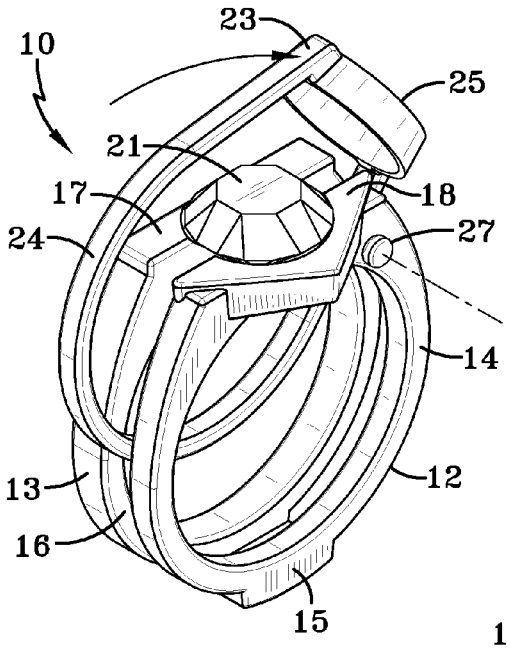
FIG. 5A is a perspective view of the article of jewelry of the first embodiment with a securing member moved relative to a frame member such that the securing member no longer secures an ornamental article in place.
Figure 5B:
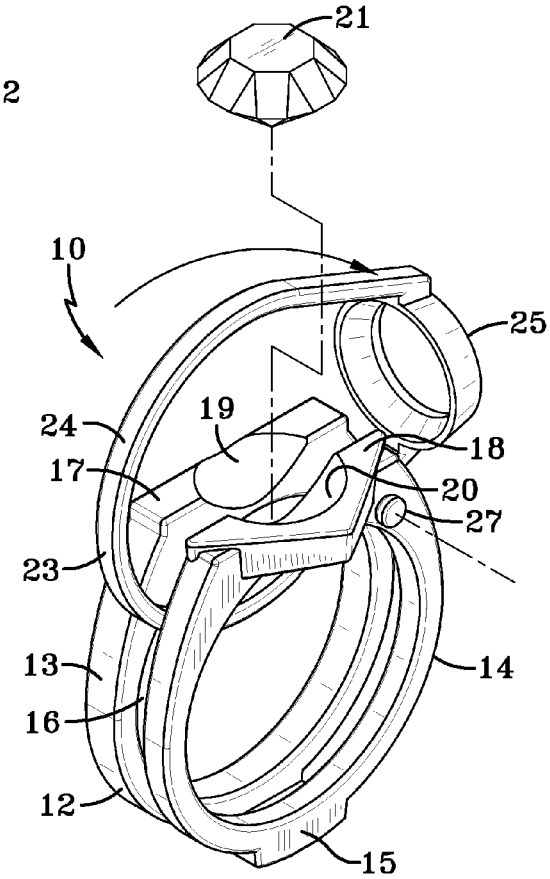
FIG. 5B is a perspective view similar to FIG. 5A with the ornamental article removed from its setting.

A first embodiment of the present invention is shown in FIGS. 3-6 and 8-10. While the articles of jewelry shown in the figures for each of the embodiments is a ring for wearing on a persons finger, it is to be understood that an article of jewelry of the present invention could be a bracelet, a pendant, a brooch, or an earring. An article of jewelry 10 has a frame member 12 and a securing member 23. The frame member comprises two spaced apart parallel rings 13, 14 that are permanently fixed to one another only at a first location 15. At a second location diametrically opposed to the first location 15 each of the spaced apart parallel rings 13, 14 has a pedestal 17, 18 integral therewith. It is understood that the size and shapes of the pedestals may vary to suit the practical and aesthetic tastes of a manufacturer and consumer of a jewelry article of any of the embodiments the present invention disclosed herein. As used herein and in the claims the term "pedestal" is understood to have its ordinary meaning of a supporting structure or piece. Each of the pedestals 17, 18 has a notch 19, 20 therein at an edge of the pedestal adjacent a space 16 separating the parallel rings 13, 14. As used herein and in the claims the terms "notch" and "notches" are understood to have their ordinary meanings of an angular cut, indentation, or hollow in an object, surface or edge. The pedestals and notches are circumferentially aligned to cooperate with one another to provide a seat for seating an ornamental article 21 therein. The seat for receiving a complementary portion of an ornamental article 21 is therefore not one continuous surface, but rather is provided by the surfaces of the two notches separated by the space 16 between the two parallel rings 13, 14.

The securing member 23 secures the ornamental article 21 to the frame member 12. The securing member is a ring 23 inserted in the space 16 between the parallel rings 13, 14 of the frame member 12 in a movable manner. That is to say, the securing member is disposed in the space between the parallel rings of the frame member and is movable with respect to the parallel rings of the frame member. The securing member 23 is provided with a means 25 for securing the ornamental article 21 seated in the pedestals 17, 18 and notches 19, 20 of the frame member when the means for securing is aligned with the pedestals and notches of the frame member. In the first embodiment the means for securing 25 is a bezel oriented, shown oriented perpendicular to the ring 23. As used herein and in the claims the term "bezel" is understood to have its ordinary meaning of a ring or rim holding a gem or other ornamental article in its setting. The securing member 23 is inserted in the space 16 between the parallel rings 13, 14 of the frame member 12 in a movable manner wherein the means 23 for securing the ornamental article 21 may either be aligned with the pedestals and notches of the frame member to cooperate with the frame member for securing the ornamental article seated in the pedestals and notches of the frame member, or the securing member may be moved with respect to the frame member displacing the means 23 for securing the ornamental article 21 to allow the ornamental article to be removed from the pedestals and notches of the frame member and replaced by another ornamental article.

It is understood that the frame member 12 and the securing member 23 may comprise any suitable material, or materials, selected to suit the practical and aesthetic tastes of a manufacturer and consumer of a jewelry article of any of the embodiments the present invention disclosed herein. Such materials include for example metals and alloys thereof, and polymers. The frame member and securing member may comprise the same or different materials. It is understood that the frame member and securing member may be fabricated without undue experimentation by those skilled in the art of making article of jewelry using any suitable and well known methods including casting, molding, welding, soldering, machining, bending, and so forth.

It is understood that the shape and size of an ornamental article for an article of jewelry of the present invention may vary to suit the practical and aesthetic tastes of a manufacturer and consumer of a jewelry article of any of the embodiments the present invention disclosed herein. It is further understood that the composition and color of an ornamental article for an article of jewelry of the present invention may vary to suit the practical and aesthetic tastes of a manufacturer and consumer of a jewelry article of any of the embodiments the present invention disclosed herein. For example the ornamental article may be a genuine or artificial gemstone, or a ceramic, or a polymer, or a metal. In the embodiments shown in the figures the ornamental article is an artificial gemstone. It is anticipated that an article of jewelry according to the invention may be marketed with a supply of variously colored artificial gemstones, all of which are sized and shaped to be complementary with the sizes and shapes of the corresponding pedestals, notches and means for securing the ornamental article in the notches that are a setting for the ornamental article.

Figure 6:
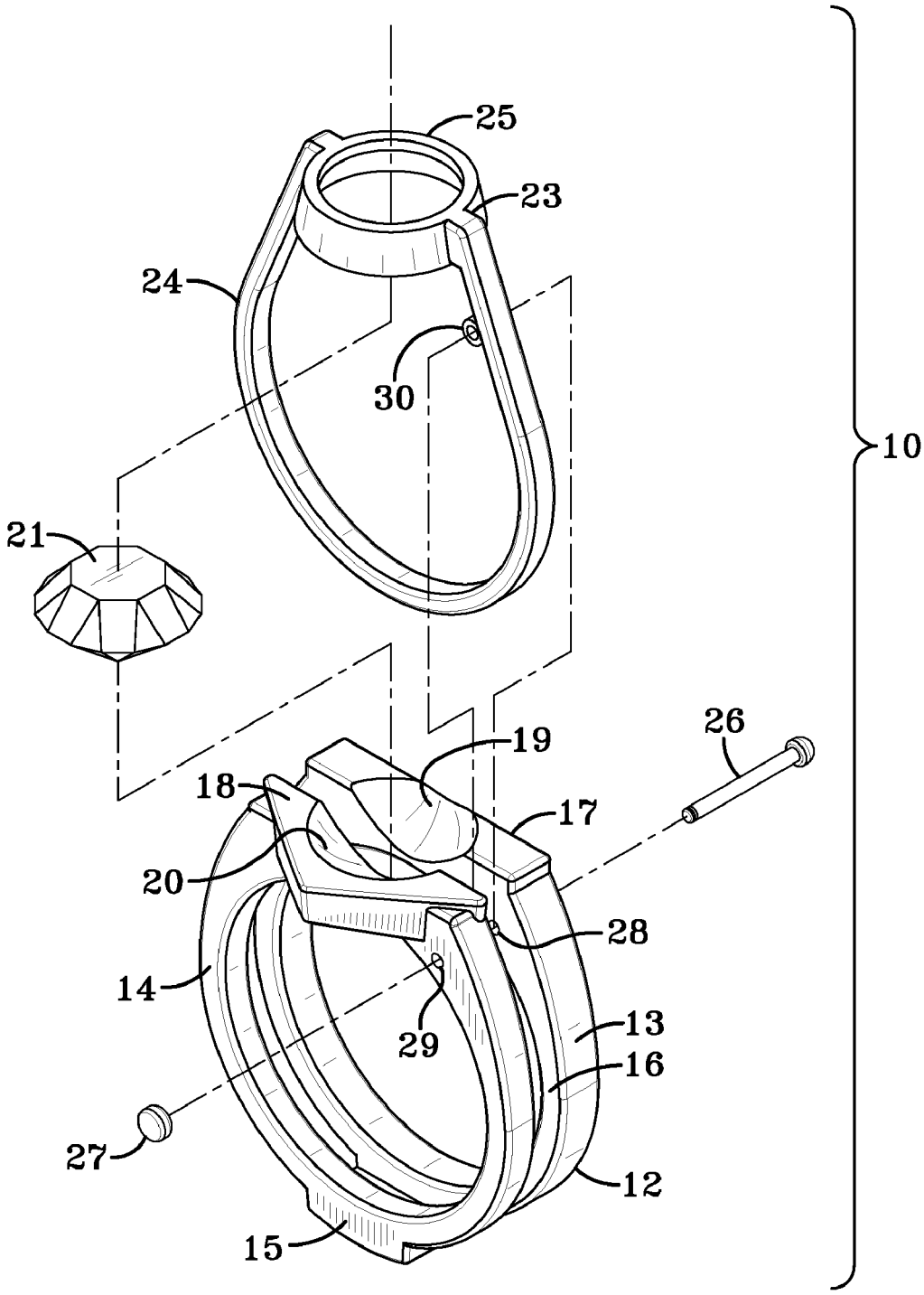
FIG. 6 is an exploded view of the article of jewelry of the first embodiment.

In the article of jewelry 10 of the first embodiment the securing member 23 is fixed to the frame member 12 by a pivot pin 26. As best shown in FIG. 6, the pivot pin 26 passes through: a hole 28 in one of the parallel spaced apart rings 13 of the frame member 12; a hole 30 in a protrusion that extends from the ring 24 of the securing member 23; and a hole 29 in the other of the parallel spaced apart rings 14 of the frame member 12. The pivot pin 26 has an enlarged head at one end for engaging a ring 13 of the frame member 12, and a cap 27 is fixed to the other end of the pivot pin adjacent the other ring 14 of the frame member to secure the pivot pin in its operative position. The resultant structure is like a door hinge that enables the securing member to be pivoted with respect to the frame member as indicated by the arrows in FIGS. 5A and 5B, allowing the ornamental article 21 to be removed from the notches 19, 20 and be replaced by another ornamental article. The securing member can then be pivoted back into alignment with the parallel spaced apart rings of the frame member with the means for securing the ornamental article seated in the pedestals and notches, in this embodiment the bezel 25 is once again positioned to secure the ornamental article in place. While the location of the pivot pin may be varied, it worked well at the location shown near the pedestals in the figures.

It is to be understood that features of the invention such as the shapes of the pedestals 17, 18, the dimensions of the frame member 12, the sizes and shapes of the notches 19, 20 to be complementary to the size and shape of the ornamental article 21, and so forth may be varied to meet the needs and aesthetic tastes of the manufacturer and consumer of articles of jewelry according to the invention.

In each embodiment of an article of jewelry disclosed herein the securing member and the frame member, including the space between the parallel spaced apart rings of the frame member, are dimensioned such that the securing member adjoins the frame member with friction resisting relative movement of the securing member with respect to the frame member.

Figure 7:
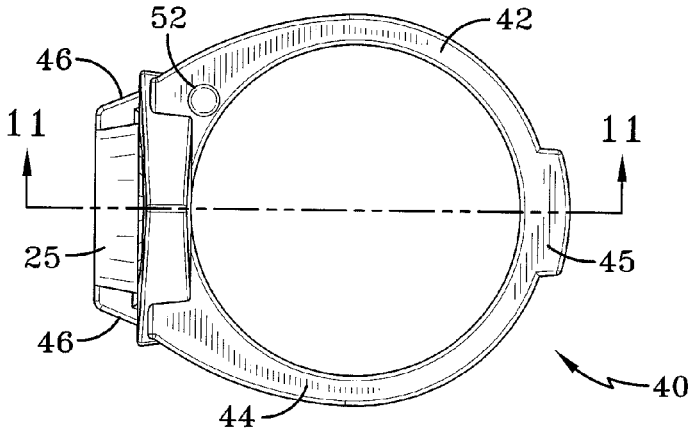
FIG. 7 is a front elevation view of an article of jewelry according to a second embodiment of the invention.
Figure 8:
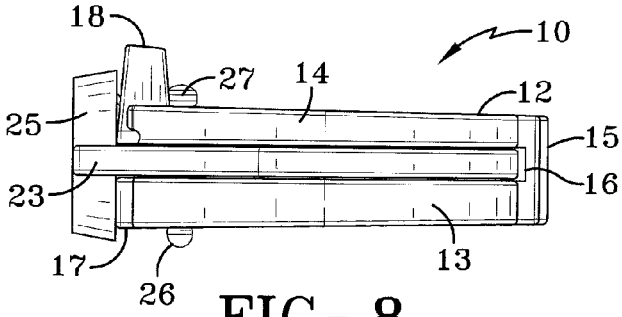
FIG. 8 is a side elevation view of the article of jewelry of the first embodiment.
Figure 9:
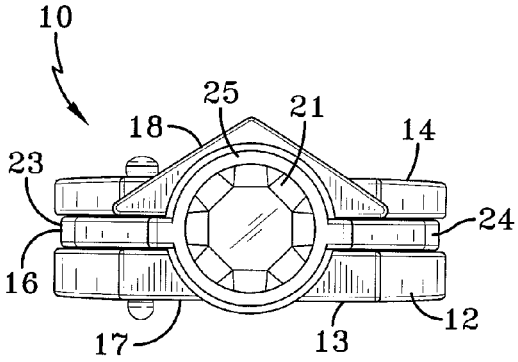
FIG. 9 is a top view of the article of jewelry of the first embodiment.
Figure 10:
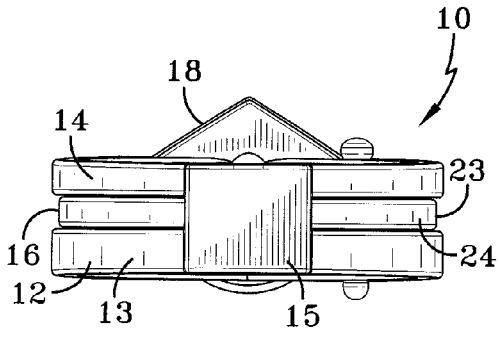
FIG. 10 is a bottom view of the article of jewelry of the first embodiment.
Figure 11:
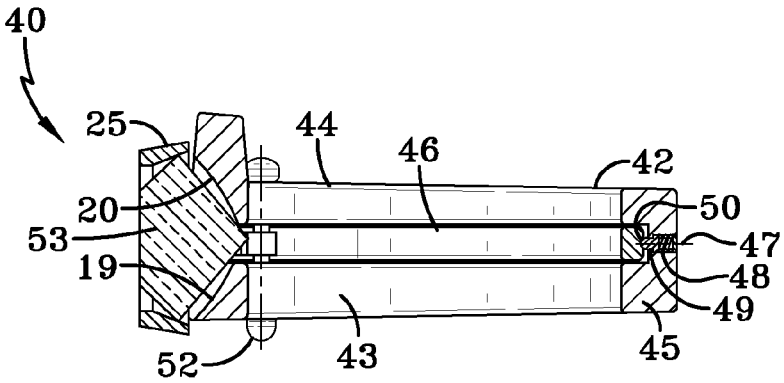
FIG. 11 is a cross sectional view of the article of jewelry according to the second embodiment of FIG. 7 taken along line 11-11 of FIG. 7.
Figure 12:
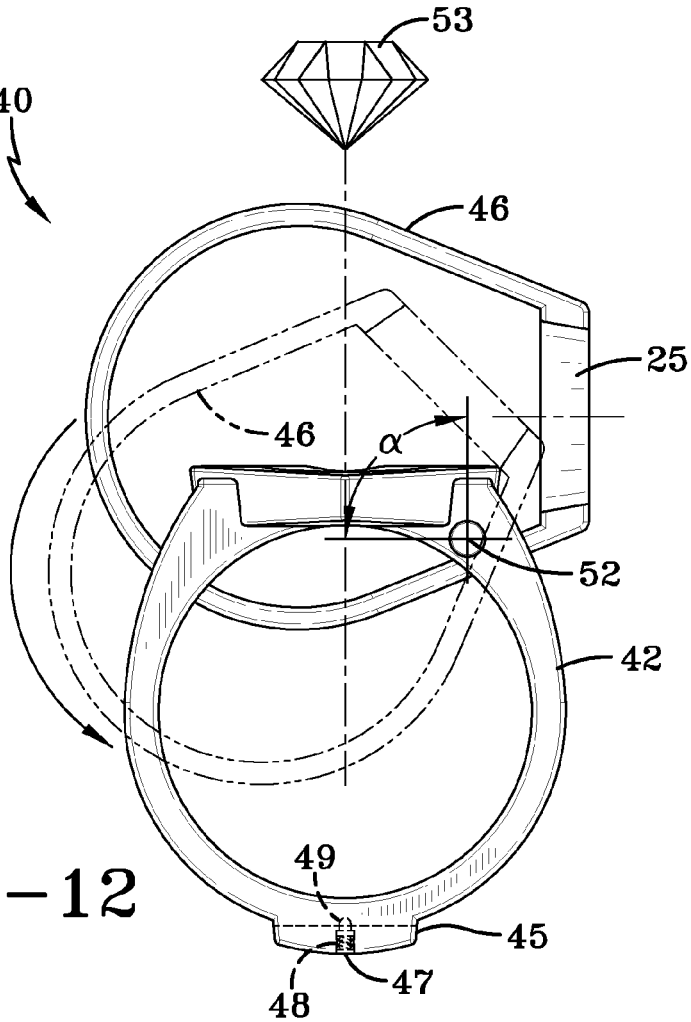
FIG. 12 is a front elevation view of the article of jewelry according to the second embodiment of FIG. 7, with a securing member moved relative to a frame member such that the securing member no longer secures an ornamental article in place, and partially broken away to show a means for restricting movement of the securing member with respect to the frame member in a releasable manner.

An article of jewelry 40 according to a second embodiment of the invention is shown in FIGS. 7, 11 and 12. The second embodiment is substantially like the first embodiment comprising a frame member 42 and a securing member 46. The frame member comprises two spaced apart parallel rings 43, 44 that are permanently fixed to one another only at a first location 45. The securing member is fixed to the frame member by a pivot pin 52 as in the first embodiment, and the article of jewelry secures an ornamental article 53 in a replaceable manner as described above for the first embodiment. However, the second embodiment further comprises a means for restricting movement of the securing member 46 with respect to the frame member 42 in a releasable manner when the means for securing the ornamental article is securing the ornamental article seated in the pedestals and notches of the frame member. A well 47 in the portion 45 of the frame member 42 securing the spaced apart parallel rings 43, 44 to one another contains a coil spring 48 that bias a sphere 49 towards the center of the frame member and engages a shallow detent 50 in a circumferentially extending outer surface of the securing member 46 as best shown in FIG. 11. When the securing member 46 is pivoted a sufficient angle $\alpha$ to allow the removal and insertion of the ornamental article 53 in the frame member, as shown in FIG. 12 the sphere is urged towards the center of the frame member, but only with a relatively minor force. When the securing member is pivoted back to have the means for securing engage the ornamental article and retain it in place, the securing member urges the sphere 49 away from the center of the frame member with the sphere engaging the detent 50 in the circumferentially extending outer surface of the securing member 46. This means for restricting movement of the securing member 46 with respect to the frame member 42 in a releasable manner may be incorporated in any of the embodiments disclosed herein, and supplements the friction between the securing member and the rings of the frame member to restrict relative movement of these parts when the article of jewelry, such as a ring, is not being worn.

Figure 13:
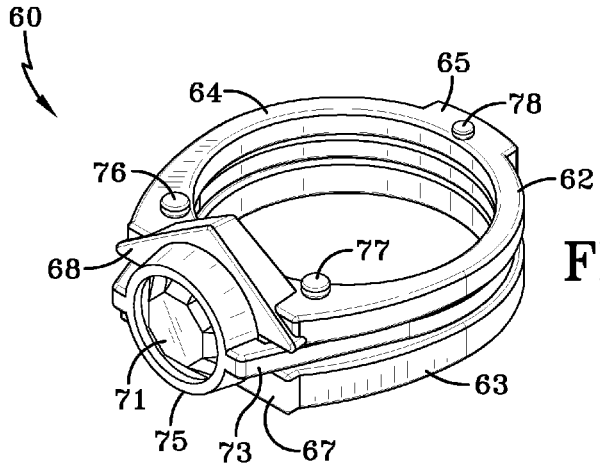
FIG. 13 is a perspective view of an article of jewelry according to a third embodiment of the invention.
Figure 14:
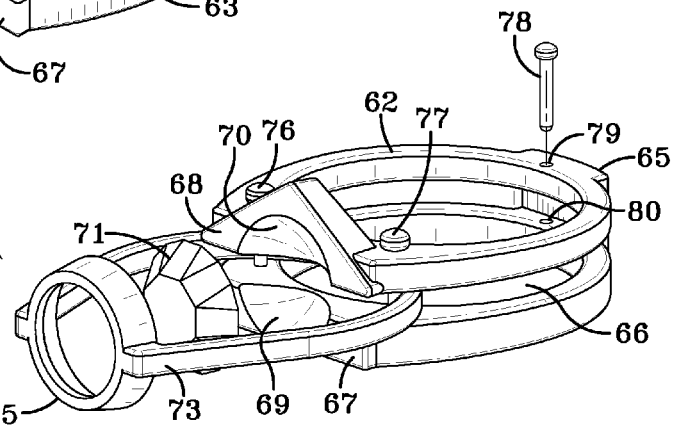
FIG. 14 is a perspective view of the article of jewelry of the third embodiment with a securing member moved relative to a frame member such that the securing member no longer secures an ornamental article in place.
Figure 15:
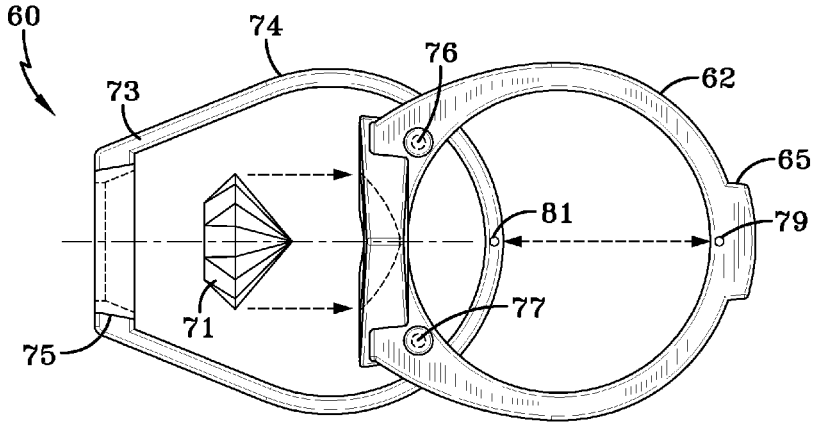
FIG. 15 is a front elevation view of the article of jewelry of the third embodiment with a securing member moved relative to a frame member such that the securing member no longer secures an ornamental article in place.

An article of jewelry 60 according to a third embodiment of the invention is shown in FIGS. 13-15. The third embodiment is similar to the first and second embodiment comprising a frame member 62 and a securing member 73. The frame member comprises two spaced apart parallel rings 63, 64 that are permanently fixed to one another only at a first location 65. At a second location diametrically opposed to the first location 65 each of the spaced apart parallel rings 63, 64 has a pedestal 67, 68 integral therewith. Each of the pedestals has a notch 69, 70 therein at an edge of the pedestal adjacent a space 66 separating the parallel rings. The securing member 73 is a ring 74 provided with a means 75 for securing the ornamental article 71 seated in the pedestals 67, 68 and notches 69, 70 of the frame member when the means for securing is aligned with the pedestals and notches of the frame member. As in the first embodiment the means for securing 75 is a bezel, shown oriented perpendicular to the ring 74. The securing member 73 is inserted in the space 66 between the parallel rings 63, 64 of the frame member 62 in a movable manner wherein the means 75 for securing the ornamental article 71 may either be aligned with the pedestals and notches of the frame member to cooperate with the frame member for securing the ornamental article seated in the pedestals and notches of the frame member, or the securing member may be moved with respect to the frame member displacing the means 75 for securing the ornamental article 71 to allow the ornamental article to be removed from the pedestals and notches of the frame member and replaced by another ornamental article.

In this third embodiment two stop members 76, 77, shown here as pins, extend between the parallel rings 63, 64 of the frame member 62 with the stop members located inside the ring 74 of the securing member 73 to prevent the securing member from being separated from the frame member while allowing the securing member to be movable with respect to the frame member. As shown in FIGS. 14 and 15 the securing member may be moved only a limited distance in a substantially radial direction with respect to the frame member, the limited distance being sufficient to allow for removal and replacement of the ornamental article 71. The stop members 76, 77 prevent removal of the securing member from the frame member.

The third embodiment further comprises a means 78 for restricting movement of the securing member 73 with respect to the frame member 62 in a releasable manner when the means 75 for securing the ornamental article 71 is securing the ornamental article seated in the 67, 68 and notches 69, 70 of the frame member. A pin 78 that is removable, or at least movable sufficiently to not pass through the securing member, extends through aligned holes 79, 80, 81 in the frame member and securing member. This means for restricting movement of the securing member 73 with respect to the frame member 62 in a releasable manner may be incorporated in any of the embodiments disclosed herein, and supplements the friction between the securing member and the rings of the frame member to restrict relative movement of these parts when the article of jewelry, such as a ring, is not being worn.

Figure 16:
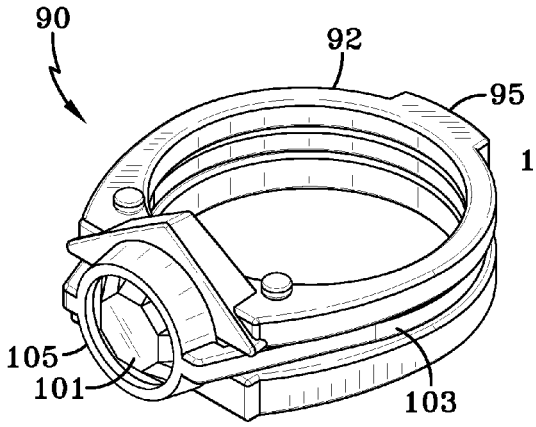
FIG. 16 is a first perspective view of an article of jewelry according to a fourth embodiment of the invention.
Figure 17:
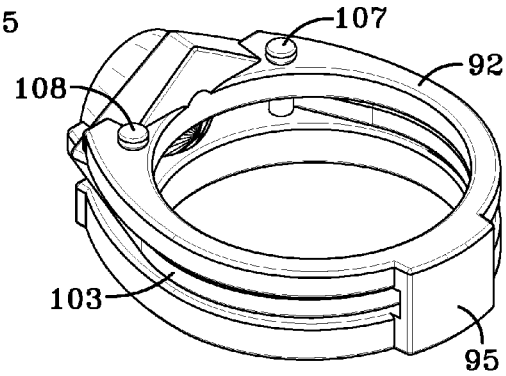
FIG. 17 is a second perspective view of the article of jewelry according to a fourth embodiment of the invention.
Figure 18:
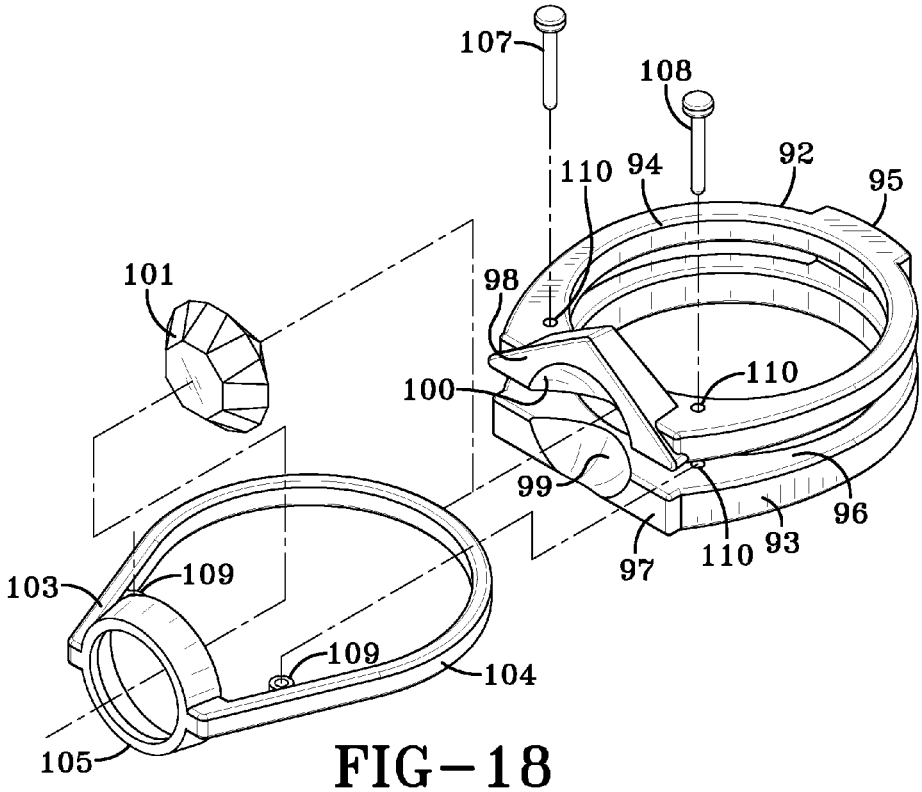
FIG. 18 is an exploded view of the article of jewelry of the fourth embodiment.

FIGS. 16-18 show an article of jewelry according to a fourth embodiment of the invention. The fourth embodiment is similar to the first, second and third embodiments, comprising a frame member 92 and a securing member 103. The frame member comprises two spaced apart parallel rings 93, 94 that are permanently fixed to one another only at a first location 95. At a second location diametrically opposed to the first location 95 each of the spaced apart parallel rings 93, 94 has a pedestal 97, 98 integral therewith. Each of the pedestals has a notch 99, 100 therein at an edge of the pedestal adjacent a space 96 separating the parallel rings. The securing member 103 is a ring 104 provided with a means 105 for securing the ornamental article 101 seated in the pedestals 97, 98 and notches 99, 100 of the frame member when the means for securing is aligned with the pedestals and notches of the frame member. As in the first embodiment the means for securing 105 is a bezel, shown oriented perpendicular to the ring 104. The securing member 103 is inserted in the space 96 between the parallel rings 93, 94 of the frame member 92 in a movable manner wherein the means 105 for securing the ornamental article 101 may either be aligned with the pedestals and notches of the frame member to cooperate with the frame member for securing the ornamental article seated in the pedestals and notches of the frame member, or the securing member may be moved with respect to the frame member displacing the means 105 for securing the ornamental article 101 to allow the ornamental article to be removed from the pedestals and notches of the frame member and replaced by another ornamental article.

In this fourth embodiment the securing member 103 has two protrusions 109 extending into the interior of the ring 104 with each protrusion having a passage extending through it. Each of the spaced apart parallel rings 93, 94 of the frame member 92 is provided with passages 110 for receiving movable pins 107, 108 that extend through the aligned passages in the protrusions 109 of the securing member to fix the securing member to the frame member. The movable pins 107 are movable to not extend through the passages in the protrusions of the securing member whereby the securing member can be removed from the space 96 between the parallel rings of the frame member.

Figure 19:
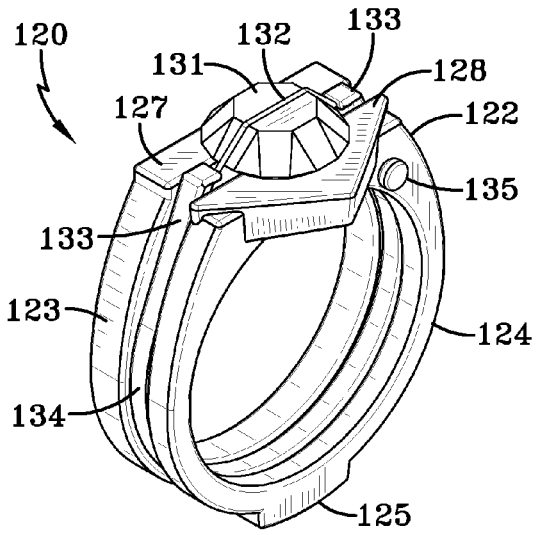
FIG. 19 is a perspective view of an article of jewelry according to a fifth embodiment of the invention.
Figure 20:
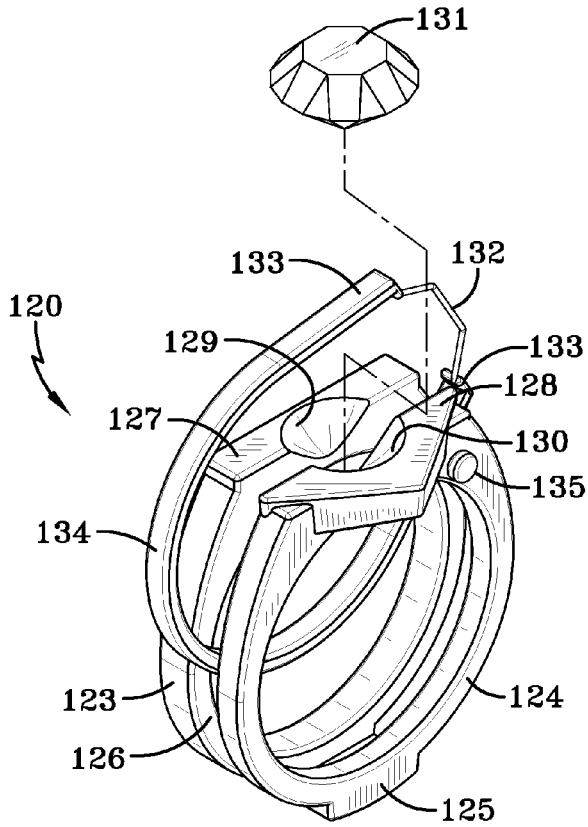
FIG. 20 is a perspective view of the article of jewelry of the fifth embodiment with a securing member moved relative to a frame member such that the securing member no longer secures an ornamental article in place.

FIGS. 19 and 20 show an article of jewelry 120 according to a fifth embodiment of the invention. The fifth embodiment is similar to the first through fourth embodiments, comprising a frame member 122 and a securing member 133. The frame member comprises two spaced apart parallel rings 123, 124 that are permanently fixed to one another only at a first location 125. At a second location diametrically opposed to the first location 125 each of the spaced apart parallel rings 123, 124 has a pedestal 127, 128 integral therewith. Each of the pedestals has a notch 129, 130 therein at an edge of the pedestal adjacent a space 126 separating the parallel rings. The securing member 133 is a ring 134 provided with a means 132 for securing the ornamental article 131 seated in the pedestals 127, 128 and notches 129, 130 of the frame member when the means for securing 132 is aligned with the pedestals and notches of the frame member. This embodiment differs from the other embodiments in that the means for securing 132 is a single rigid wire that is aligned with, not perpendicular to, the ring 134 of the securing member and is configured to be complimentary to, and adjacent to, a surface of the ornamental article to secure the ornamental article in the pedestals and notches of the frame member. As in the previously described embodiments, the securing member 133 is inserted in the space 126 between the parallel rings 123, 124 of the frame member 122 in a movable manner wherein the means 132 for securing the ornamental article 131 may either be aligned with the pedestals and notches of the frame member to cooperate with the frame member for securing the ornamental article seated in the pedestals and notches of the frame member, or the securing member may be moved with respect to the frame member displacing the means 132 for securing the ornamental article 131 to allow the ornamental article to be removed from the pedestals and notches of the frame member and replaced by another ornamental article. While the fifth embodiment is shown provided with a pivot pin 135 like the first embodiment, it is to be understood that any of the embodiments may have a means for securing like that disclosed in this fifth embodiment.

Figure 21:
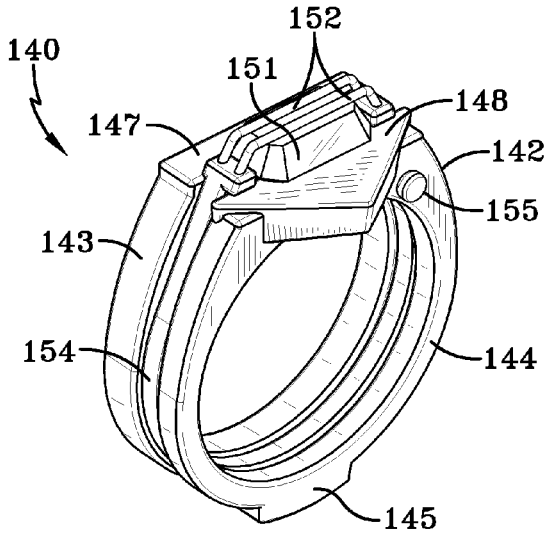
FIG. 21 is a perspective view of an article of jewelry according to a sixth embodiment of the invention.
Figure 22:
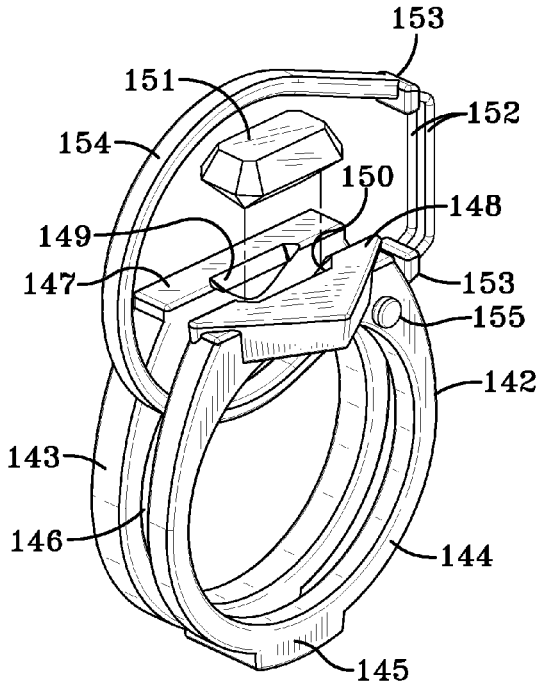
FIG. 22 is a perspective view of the article of jewelry of the sixth embodiment with a securing member moved relative to a frame member such that the securing member no longer secures an ornamental article in place.
Figure 23:
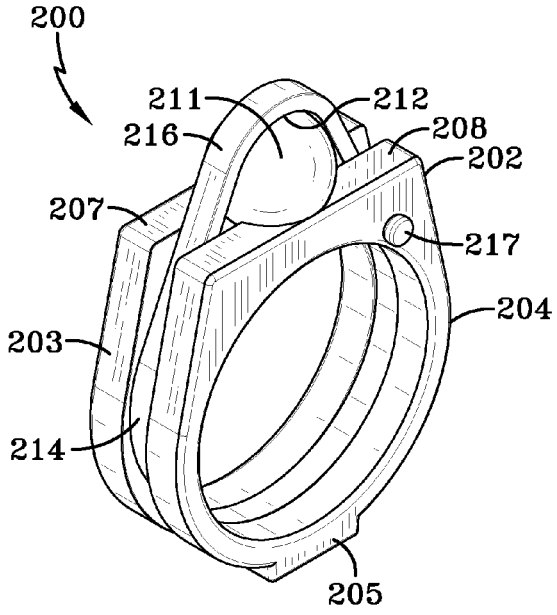
FIG. 23 is a perspective view of an article of jewelry according to a seventh embodiment of the invention.

FIGS. 21 and 23 show an article of jewelry 140 according to a sixth embodiment of the invention. The sixth embodiment is similar to the first through fifth embodiments, comprising a frame member 142 and a securing member 153. The frame member comprises two spaced apart parallel rings 143, 144 that are permanently fixed to one another only at a first location 145. At a second location diametrically opposed to the first location 145 each of the spaced apart parallel rings 143, 144 has a pedestal 147, 148 integral therewith. Each of the pedestals has a notch 149, 150 therein at an edge of the pedestal adjacent a space 146 separating the parallel rings. The securing member 153 is a ring 154 provided with a means 152 for securing the ornamental article 151 seated in the pedestals 147, 148 and notches 149, 150 of the frame member when the means for securing 152 is aligned with the pedestals and notches of the frame member. This embodiment differs from the other embodiments in that the means for securing 152 when viewed head on is a parallelogram shaped member comprising two parallel rigid wire that is aligned with, not perpendicular to, the ring 154 of the securing member and is configured to be complimentary to, and adjacent to, a surface of the ornamental article to secure the ornamental article in the pedestals and notches of the frame member. Such a means for securing may be selected by a designer or manufacturer of an article of jewelry according to the invention to accommodate the shape of an ornamental article used with the article of jewelry. As in the previously described embodiments, the securing member 153 is inserted in the space 146 between the parallel rings 143, 144 of the frame member 142 in a movable manner wherein the means 152 for securing the ornamental article 151 may either be aligned with the pedestals and notches of the frame member to cooperate with the frame member for securing the ornamental article seated in the pedestals and notches of the frame member, or the securing member may be moved with respect to the frame member displacing the means 152 for securing the ornamental article 101 to allow the ornamental article to be removed from the pedestals and notches of the frame member and replaced by another ornamental article. While the sixth embodiment is shown provided with a pivot pin 155 like the first embodiment, it is to be understood that any of the embodiments may have a means for securing like that disclosed in this sixth embodiment.

Figure 24:
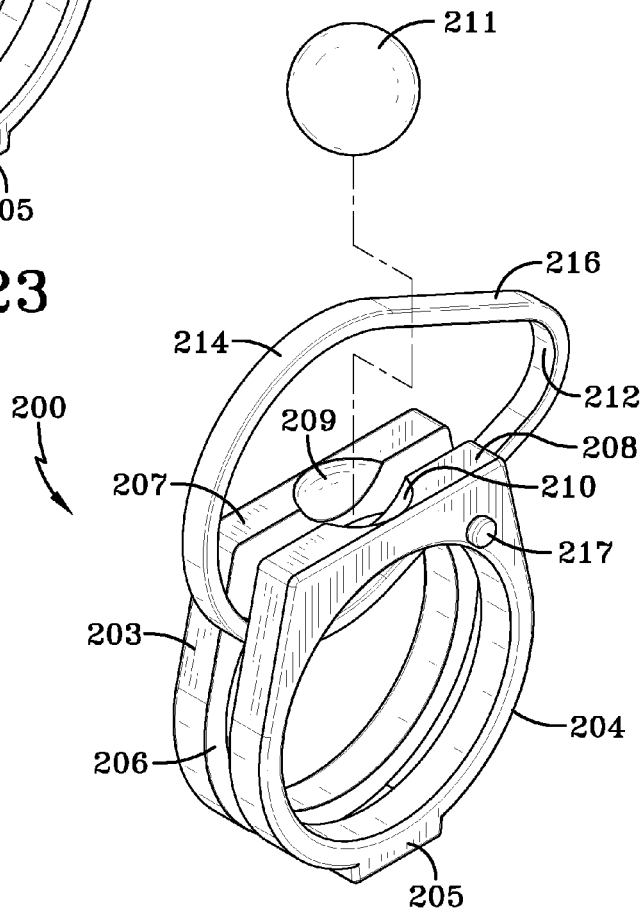
FIG. 24 is a perspective view of the article of jewelry of the seventh embodiment with a securing member moved relative to a frame member such that the securing member no longer secures an ornamental article in place.

FIGS. 23 and 24 show an article of jewelry 200 according to a seventh embodiment of the invention. The seventh embodiment is similar to the first through sixth embodiments, comprising a frame member 202 and a securing member 216. The frame member comprises two spaced apart parallel rings 203, 204 that are permanently fixed to one another only at a first location 205. At a second location diametrically opposed to the first location 205 each of the spaced apart parallel rings 203, 204 has a pedestal 207, 208 integral therewith. Each of the pedestals has a notch 209, 210 therein at an edge of the pedestal adjacent a space 206 separating the parallel rings. The securing member 216 is a ring 214 provided with a means 212 for securing the ornamental article 211 seated in the pedestals 207, 208 and notches 209, 210 of the frame member when the means for securing 212 is aligned with the pedestals and notches of the frame member. This embodiment differs from the other embodiments in that the ornamental article 211 is spherical with the notches 209, 210 configured to be complementary to a spherical surface of the ornamental article 211. The means for securing 212 is an arch that is a non-arcuate continuation of the ring 214 having a surface that is complementary to a spherical surface of the ornamental article to secure the ornamental article in the pedestals and notches of the frame member. As in the previously described embodiments, the securing member 216 is inserted in the space 206 between the parallel rings 203, 204 of the frame member 202 in a movable manner wherein the means 212 for securing the ornamental article 211 may either be aligned with the pedestals and notches of the frame member to cooperate with the frame member for securing the ornamental article seated in the pedestals and notches of the frame member, or the securing member may be moved with respect to the frame member displacing the means 212 for securing the ornamental article 211 to allow the ornamental article to be removed from the pedestals and notches of the frame member and replaced by another ornamental article. While the sixth embodiment is shown provided with a pivot pin 217 like the first embodiment, it is to be understood that any of the embodiments may have a means for securing like that disclosed in this seventh embodiment.

While the invention has been described with reference to certain exemplary embodiments, obvious modifications and alterations are possible by those skilled in the related art. Therefore, it is intended that the invention include all such modifications and alterations to the full extent that they come within the scope of the following claims or the equivalents thereof.

The invention claimed is:

1. An article of jewelry comprising:

(a) a frame member comprising two spaced apart parallel rings that are fixed to one another at a first location, at a second location diametrically opposed to the first location each of the spaced apart parallel rings has a pedestal with a notch therein at an edge of the pedestal adjacent a space separating the parallel rings, the pedestals and notches are circumferentially aligned to cooperate with one another to provide a seat for seating thereon an ornamental article;

(b) a securing member for securing the ornamental article to the frame member, the securing member being a ring inserted in the space between the parallel rings of the frame member and fixed to the frame member by a pivot pin that is located nearer to said second location than to said first location, the securing member provided with a bezel for securing the ornamental article on the seat of the frame member when the bezel is aligned with the seat of the frame member, at least a portion of the ornamental article being adjacent to and disposed between the bezel and the seat of the frame member with the bezel disposed radially outward of at least a portion of the ornamental article, the securing member pivoting about the pivot in to allow placement of the ornamental article on the seat and the removal of the ornamental article from the seat.

2. The article of jewelry of claim 1 wherein the securing member and the frame member are dimensioned such that the securing member adjoins the frame member with friction resisting relative movement of the securing member with respect to the frame member.

3. The article of jewelry of claim 2 further comprising a means for restricting movement of the securing member with respect to the frame member in a releasable manner when the bezel is securing the ornamental article on the seat of the frame member.

4. The article of jewelry of claim 1 further comprising a means for restricting movement of the securing member with respect to the frame member in a releasable manner when the bezel is securing the ornamental article on the seat of the frame member.

5. The article of jewelry of claim 1 wherein the bezel has a round shape when viewed head-on.

6. An article of jewelry comprising:

(a) a frame member comprising two spaced apart parallel rings that are fixed to one another at a first location, at a second location diametrically opposed to the first location each of the spaced apart parallel rings has a pedestal with a notch therein at an edge of the pedestal adjacent a space separating the parallel rings, the pedestals and notches are circumferentially aligned to cooperate with one another to provide a seat for seating thereon an ornamental article;

(b) a securing member for securing the ornamental article to the frame member, the securing member being a ring provided with a bezel, the securing member being inserted in the space between the parallel rings of the frame member and fixed to both rings of the frame member by a pivot pin that is located nearer to said second location than to said first location, wherein the bezel may either be aligned with the seat of the frame member to secure the ornamental article on the seat of the frame member, at least a portion of the ornamental article being adjacent to and disposed between the bezel and the seat of the frame member with the bezel disposed radially outward of at least a portion of the ornamental article, or the securing member may be moved with respect to the frame member by moving the securing member about the pivot pin displacing the bezel to allow the ornamental article to be removed from the seat of the frame member and replaced by another ornamental article;

wherein the securing member and the frame member are dimensioned such that the securing member adjoins the frame member with friction resisting relative movement of the securing member with respect to the frame member.

7. The article of jewelry of claim 6 further comprising a means for restricting movement of the securing member with respect to the frame member in a releasable manner when the bezel of the securing member is securing the ornamental article on the seat of the frame member.

8. The article of jewelry of claim 6 wherein the bezel has a round shape when viewed head-on.

* * * * *